United States Patent [19]

Yamamoto et al.

[11] Patent Number: 4,766,460

[45] Date of Patent: Aug. 23, 1988

[54] COLOR ELECTROPHOTOGRAPHIC METHOD

[75] Inventors: Hajime Yamamoto, Ibaraki; Yuji Takashima, Nishinomiya, both of Japan

[73] Assignee: Matsushita Electric Industrial Co., Ltd., Kadoma, Japan

[21] Appl. No.: 92,184

[22] Filed: Sep. 2, 1987

[30] Foreign Application Priority Data

Sep. 3, 1986 [JP] Japan ..... 61-207235
Oct. 2, 1986 [JP] Japan ..... 61-234816
Oct. 2, 1986 [JP] Japan ..... 61-234818

[51] Int. Cl.[4] ..... G03G 15/01

[52] U.S. Cl. ..... 355/4; 355/3 CH; 355/14 CH; 355/3 DD; 355/77; 430/120

[58] Field of Search ..... 355/4, 3 R, 3 DD, 77, 355/3 CH, 14 CH, 14 D; 430/31, 42, 44, 120, 122

[56] References Cited

U.S. PATENT DOCUMENTS 4,669,864 6/1987 Shoji et al. ..... 355/4
4,679,929 7/1987 Haneda et al. ..... 355/4

*Primary Examiner*—R. L. Moses
*Attorney, Agent, or Firm*—Cushman, Darby & Cushman

[57] ABSTRACT

In a color electrophotographic process wherein color toners are developed by toner flying under D.C. electric field, electrostatic capacitance of photoconductor (29, 30, 46, 65) is selected under 170 pF/cm$^2$, so that undesirable discharging through the toner layer is prevented, and color contamination due to the discharging is prevented thereby providing clear color image printing.

20 Claims, 8 Drawing Sheets

COLOR ELECTROPHOTOGRAPHIC METHOD

FIELD OF THE INVENTION AND RELATED ART STATEMENT

1. Field of the Invention

The present invention relates to a color electrophotographic method which is to be used for a color copier, a color printer or the like, and to a color electrophotographic apparatus.

2. Description of the Related Art

Hitherto, a onetime transfer type color electrophotographic apparatus has been proposed. In such apparatus, plural different color toner images are formed on a photoconductor by repetition of sequences each comprising electric chargings, exposures of light image and developings, to make plural color toner images, and a composite color picture is obtained by transferring such plural color toner image at onetime.

A conventional onetime transfer type color electrophotographic apparatus, for example that which is shown in Japanese published unexamined patent application Sho 60-95456 is described with reference to FIG. 1 and FIG. 2.

FIG. 1 is a schematic cross-sectional side view of the conventional color electrophotographic apparatus using a conventional process. The conventional color electrophotographic apparatus comprises a photoconductor 1 which is made of selenium-tellurium (Se-Te) and rotates in clockwise direction, a corona charger 2 which electrically charges the photoconductor 1, a laser beam scanner 3, developers 4, 5, 6 and 7 which respectively contain yellow, magenta, cyanic and black toners, an image receiving paper 8, an eraser lamp 9, a corona transfer 10, a fuser 11, a cleaning blade 12 and another eraser lamp 13 for resetting a surface potential of the photoconductor 1 to the previous state.

FIG. 2 shows the detailed constitution of the developer 4, 5, 6 or 7. The developer comprises a two-components developer 14 (hereinafter abbreviated as the developer) which contains a mixture of a positively charged toner 20 and a magnetic carrier, a rotary developing sleeve 15 which is made of aluminum or the like non-magnetic metal, a magnet roller 16, a layer thickness control blade 17 for controlling the layer thickness of the developer 14 on the developing sleeve 15, a scraper 18 for scraping the developer 14 after completion of the developing, a rotary blade 19 for stirring up the developer 14, toner to be supplied, a toner supplying roller 21 and an electric power source 22 for making a toner flying potential which is made by superposing a high voltage alternating potential over a D.C. potential. In order to set up the developers in a developable state, the toner carrier 15 is connected to the electric power source 22. And in order to set up the developers in an indevelopable state, the toner carrier 15 is electrically floated or grounded, or is applied with a negative D.C. potential.

Method for making a color picture by using the above-mentioned conventional apparatus is described as follows. First, a negative latent image for yellow toner of electrostatic charge (in which the surface potential of the photoconductor is decreased along the line-image by the image exposure) is formed by scanning of light exposure of image signals of yellow component by the laser scanner 3 after positive electric charging of the photoconductor 1 by the corona charger 2. And a toner image of yellow is formed on the photoconductor 1 by reversal development of the electrostatic latent image from negative to positive by the developer 4 which contains the yellow toner. In such case, only the developer 4 which contains the yellow toner is connected to the electric power source 22, and other developers 5, 6 and 7 are adjusted to indevelopable state which is to be described later. After developing by the yellow toner, the electrostatic latent image of yellow is erased by irradiating the whole parts of photoconductor 1 by the eraser lamp 13.

By repeating the similar processes of electric charging, image exposing, developing and light-erasing of electric charge to that of the above-mentioned forming of yellow toner image, toner images of yellow, magenta, cyanic and black are formed on the photoconductor 1. After finishing the formation of all the toner images of four colors, the electrostatic latent images are erased by the eraser lamp 9, and the toner images are electrostatically transferred on a plain (ordinary) paper 8 by the corona charger 2. The toner images transferred on the plain paper 8 is fixed by application of heat from heating of the fuser 11. After electrostatically transferring the toner images, the remained toners on the photoconductur 1 are cleaned up by the cleaning blade 12, thus one cycle of color image printing is over and the photoconductor 1 prepares for next image formation.

In the conventional color electrophotographic method elucidated with reference to FIG. 1, when a second toner image is formed on a photoconductor 1 which already has a first toner image, a second toner (e.g. cyan toner) is deposited on the first toner image irrespective of non-irradiation of signal light, thereby to produce undesirable color mixing. The extent of undesirable color mixing (resulting impure color) increases in proportion to the layer thickness of the first toner layer, and hence a color picture image of high color density, which needs specially thick toner layer, is not obtainable.

As a result of research of the cause of the undesirable color mixing, the followings are found: (1) a voltage across the first toner image layer on the photoconductor increases in proportion to electrostatic capacitance of the photoconductor used, (2) when the electrostatic capacitance of the photoconductor is above an electrostatic value, the voltage across the first toner image exceeds the discharge threshold voltage, hence resulting undesirable discharge; and therefore the surface potential of the above-mentioned toner image part is irregularly lowered, (3) accordingly, selection of appropriate values of the electrostatic capacitances of the photoconductor and the toner layer is important for obtaining clear color of high density without undesirable mixing of color.

Further in the conventional apparatus, when the charge potentials of the photoconductor for each image forming cycle (for each printing of four colors) and developer bias potentials for the developing of each cycle are selected respectively equal each other, the density of colors made by composition of more than two kinds of toners, such as red and green, becomes low, and further the hue of the composite color becomes unstable.

After-exposure potentials at the time after recharging of the photoconductor at toner-deposition part and non toner-deposition part are examined, and the following is confirmed: Even when a sufficient light exposure is made till the photoconductor discharges the residual potential, the after-exposure surface potential at the toner-deposition part is higher than that at the non-toner deposition part, by the extent corresponding to the electrostatic charge of the toner. Consequently, a first potential difference between the exposed part where the toner has already been attached and the non-exposed part where no toner has been attached becomes smaller than a second potential difference between the exposed part where no toner has been attached and the non-exposed part where no toner has been attached. Therefore, when the above-mentioned latent image of the exposed part is developed by applying the second toner (e.g. magenta toner) thereto, the deposition amount of the second toner (e.g. magenta toner) on the layer of the first toner (e.g. yellow toner) becomes smaller than that of the nondeposition part (wherein there is no first toner layer) of the first toner (e.g. yellow toner); and thereby the density of the composite color is lowered than expected. Furthermore, the surface potential of the toner-deposition part varies depending on the deposition amount of the deposited first toner (e.g. yellow toner), and therefore, it was hitherto difficult to achieve a stable color density of the composite color through keeping the deposition amount of the second (overriding) toner always constant.

OBJECT AND SUMMARY OF THE INVENTION

Accordingly, the object of the present invention is to provide an improved color electrophotographic method capable of producing clear color image which has no undesirable color mixing, by preventing potential lowering of photoconductor at the toner deposition part when the photoconductor bearing toner image thereon is recharged.

Another object of the present invention is to provide a color electrophotographic apparatus capable of producing color image of high color density of composite color.

The above-mentoned first object of the present invention is achieved by a color electrophotographic method having plural sequential electrophotographic steps of producing plural color toner images of different colors each comprising:

forming an electrostatic latent image on a photoconductor layer having electrostatic capacitance of 170 pF/cm$^2$ or smaller, putting thin layer of toner on a toner carrier, surface thereof being situated to oppose surface of the photoconductor layer with a predetermined gap not to make touching of both the surfaces, and applying D.C. potential between the photoconductor layer and the toner carrier, thereby to develop the latent image by a process of toner flying under D.C. electric field, transferring accumulated toner images on said photoconductor made by the sequential electrophotographic steps onto a recording medium at one time, and setting the transferred accumulated toner images on the recording medium.

The above-mentioned second object of the present invention is achieved by the color electrophotographic apparatus comprising:

latent image forming means for forming plural electrostatic latent images respectively corresponding to image signals of different colors on a surface of a photoconductor layer having electrostatic capacitance of 170 pF/cm$^2$ or smaller, plural developing means each having a toner carrier, surface whereof is situated to oppose surface of the photoconductor layer with a predetermined gap not to make touching of both of the surfaces, which are disposed in the vicinity of the photoconductor and respectively contain toners of different colors corresponding to the different color image signals, the voltage application means for applying a D.C. voltage between the photoconductor layer and the toner carrier, to make development of the latent image by toner flying under D.C. electric field, transferring means for transferring accumulated toner images made by sequential electrophotographic steps onto a recording medium at one time, and setting means for setting transferred accumulated toner images on the recording medium.

BRIEF DESCRIPTION OF THE DRAWINGS

FIG. 6 is a sectional side view of another example of color electrophotographic apparatus in accordance with the present invention.

DESCRIPTION OF THE PREFERRED EMBODIMENTS

Figure 1:
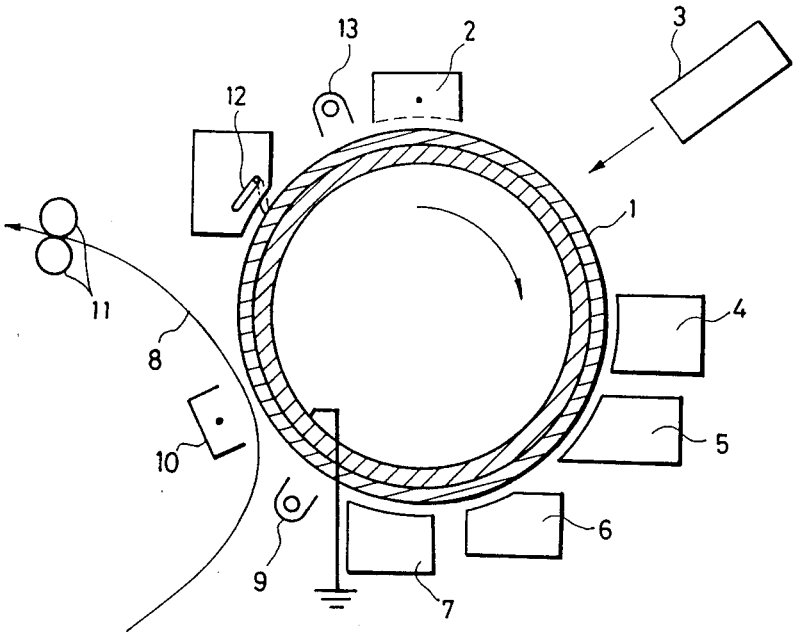
FIG.1 (Prior Art)
FIG. 1 is the cross sectional side view of essential parts of the conventional color electrophotographic apparatus.
Figure 2:
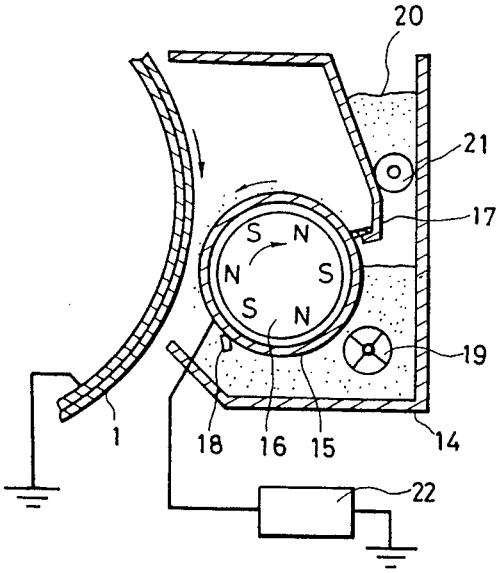
FIG.2 (Prior Art)
FIG. 2 is the cross sectional side view of the essential parts of a developer of the conventional example of FIG. 1.

It is found that in case electrostatic capacitance of the photoconductor layer used in the color electrophotographic apparatus is below 170 pF/cm$^2$, when the photoconductor which has one or more toner image layers are recharged, the voltage across the toner image layer can be suppressed low, thereby enabling prevention of undesirable discharging at the toner image layer part. The electrostatic capacitance is preferably 20 pF/cm$^2$ or higher, since the photoconductor of capacitance under 20 pF/cm$^2$ cannot retain enough electrostatic charge to make clear electrostatic latent images. When specific dielectric constant of the toner is above 3, the charged voltage across the toner layer on the photoconductor becomes such low level that undesirable discharging in the toner layer is prevented. By the above-mentioned selections, surface potential of the toner image part can be made very small, and undesirable deposition of toner of unnecessary color can be prevented.

In general, though depending on the way of developing, thickness of the toner layer at the edge part of the image is liable to be larger than the central parts of the image as a result of known edge effect which is particular to the electrophotographic method, and therefore the discharging is more liable at the edge part than the central part. Accordingly, developing method of toner flying under DC electric field, which can realize uniform developing without edge effect, is preferable for embodying the present invention.

When the charged potential of the photoconductor is raised as the sequence comprising the charging, light-exposuring and developing goes to the next same sequence, the contrast potential (potential difference) between the exposed part and the non-exposed part of the image on the previously deposited toner layer can be increased in comparison with the conventional example. In such case, color density of the composite color can be increased since the secondary toner can be sufficiently deposited on the toner-deposition part.

As a photoconductor, which is used in the present invention, an ordinary electrophotographic photoconductor, wherein photo-electric conductive materials such as amorphous selenium, arsenic selenide, CdS, ZnO, amorphous silicon or organic photoconductive material is coated on an electric conductive material, can be used; and especially the photoconductors comprising a photo-sensitive layer having electrostatic capacitance of 20–170 pF/cm$^2$ range is preferable.

To select the electrostatic capacitance of the photoconductor layer within the above-mentioned range can be made by regulating layer thickness of the photoconductor layer. For example, in case of selenium photoconductor the layer thickness should be 35–90 μm, in case of arsenic selenide photoconductor the layer thickness should be 60–90 μm, and in organic photoconductor the layer thickness should be 15–50 μm.

Though both normal developing method and reversal developing method can be used in the present invention, the reversal developing method, wherein polarity of the toner is not reversed in the re-charging, is especially preferable.

As to the toner layer thickness, in order not to make the potential across the toner layer when re-charging the photoconductor bearing the toner image layer thereon too high, in the developing process the toner layer thickness to be formed on the photoconductor by development for one color is preferably limited within the range of 5–30 μm.

As to the toner, any toner can be used as far as it has the specific dielectric constant of 3 or higher and more preferably 4 or higher. Especially for the color toner of subtractive color mixing method, non-magnetic toners which is splendid in transparency is preferable. Average particle size of the toner is preferably smaller the better, in order to increase the electrostatic capacitance of the toner layer. Accordingly, it is preferably 10 μm or smaller, and more preferably 6 μm or smaller.

Making of the dielectric constant of the toner to 3 or higher can be made, for instance by using polymer resin having the specific dielectric constant of 3 or higher, or by dispersing and mixing inorganic dielectric material having the specific dielectric constant of 3 or higher in the toner composition. Further, making of the specific dielectric constant 4 or higher can be made by mixing inorganic dielectric material having the specific dielectric constant of 4 or higher in the toner composition. The word "toner" herein means toner compositions to be used in the conventional electrophotographic process, that is defined as the composition made by dispersing pigment, charge control agent in a binder resin, and subsequently the surface of the toner powder or toner particle is coated by outer additive such as silica.

As polymer resin having the specific dielectric constant of 3 or higher, epoxy resin, melamine resin, phenol resin, alkyd resin, polyester resin, or the like, are used as binder resin, or the same are used together with other resin bonding agent.

As inorganic dielectric material, white fine powder which has as large specific dielectric constant as possible and grain size of smaller than 1 μm is usable. As such material, there are the following materials: barium sulfate, whose specific constant $\epsilon$ is . . . 11.4 alumina, whose specific constant $\epsilon$ is . . . 9.3–11.3 barium titanate, whose specific constant $\epsilon$ is . . 250–4500 titanium oxide, whose specific constant $\epsilon$ is . . . 90–170 silicon dioxide, whose specific constant $\epsilon$ is . . . 4.5.

These dielectric materials are used singly or two or more of them together, depending on necessity. The specific dielectric constant can be arbitrarily adjustable by changing amount of the dielectric materials contained in the toner composition. For instance, by mixing, 10–40 weight parts of barium sulfate or alumina for 100 weight parts of the toner composition, the specific dielectric constant of the toner can be made to 3–6. When titanium oxide of 0.1–5 weight parts is added to the above toner composition, the specific dielectric constant becomes 4–200; when titanium oxide of 1–5 weight parts are added to the above toner composition, the specific dielectric constant becomes 3–10; when silicon dioxide of 20–50 weight parts are contained in the toner composition, the specific dielectric constant becomes 3–4.

Preferable developing means used in the embodiment is a known toner flying development under electric-field, wherein a toner carrier a carrying thin layer of toner thereon is provided with a small gap not to touch the photoconductor in front of the photoconductor, and a voltage is applied between the toner carrier and the photoconductor to fly the toner on the toner carrier to the photoconductor. As has been described, a toner flying development under DC electric, wherein a DC voltage is across the toner carrier and photoconductor, is preferable.

One example of developing method in accordance with toner flying development under the DC electric field using non-magnetic toner is described with reference to FIG. 3.

Figure 3:
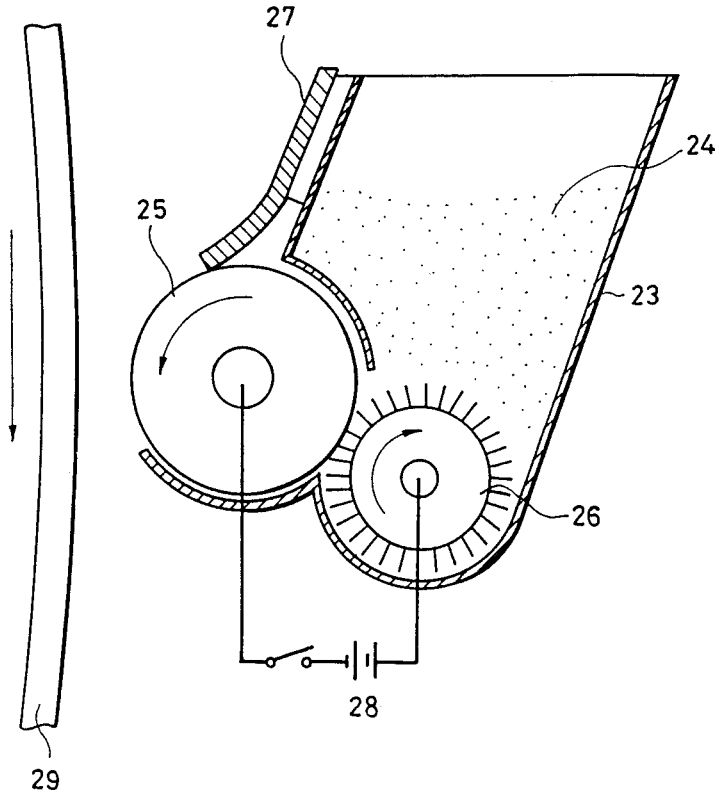
FIG. 3 is a sectional side view of essential part of the developer to be used in the present invention.

As shown in FIG. 3, in order to form a thin layer of the non-magnetic toner on the surface of the toner carrier 25, which is made of a metal cylinder of aluminum or stain-less steel, the toner carrier 25 and the fur-brush roller 26, which is made of carbon-containing resin or fine metal wires, are rotated in respective directions marked by arrows in FIG. 3. The non-magnetic toner 24 is charged by rubbing of the toner particles each other by rotation of the fur-brush roller 26, and electrostatically sticked to the toner carrier 25, which is held with a small gap to the photoconductor 29 not to touch it. The gap between the toner holder 25 and the photoconductor 29 is preferably under 300 μm, and more preferably 50–200 μm. Then the surface of the toner absorbed on the toner holder 25 is regulated to make the layer thickness uniform by the rubber blade 27, and toner thin layer of 20–50 μm is formed on the toner holder 25. The fur-brush roller 26 can be electrically floated or grounded. Amount of the toner to be supplied to the toner holder 25 can be electrically controlled by adjusting DC voltage applied between the fur-brush roller 26 and the toner holder 25. Thus the thin layer of the toner is formed.

CONCRETE WORKING EXAMPLE 1

Figure 4:
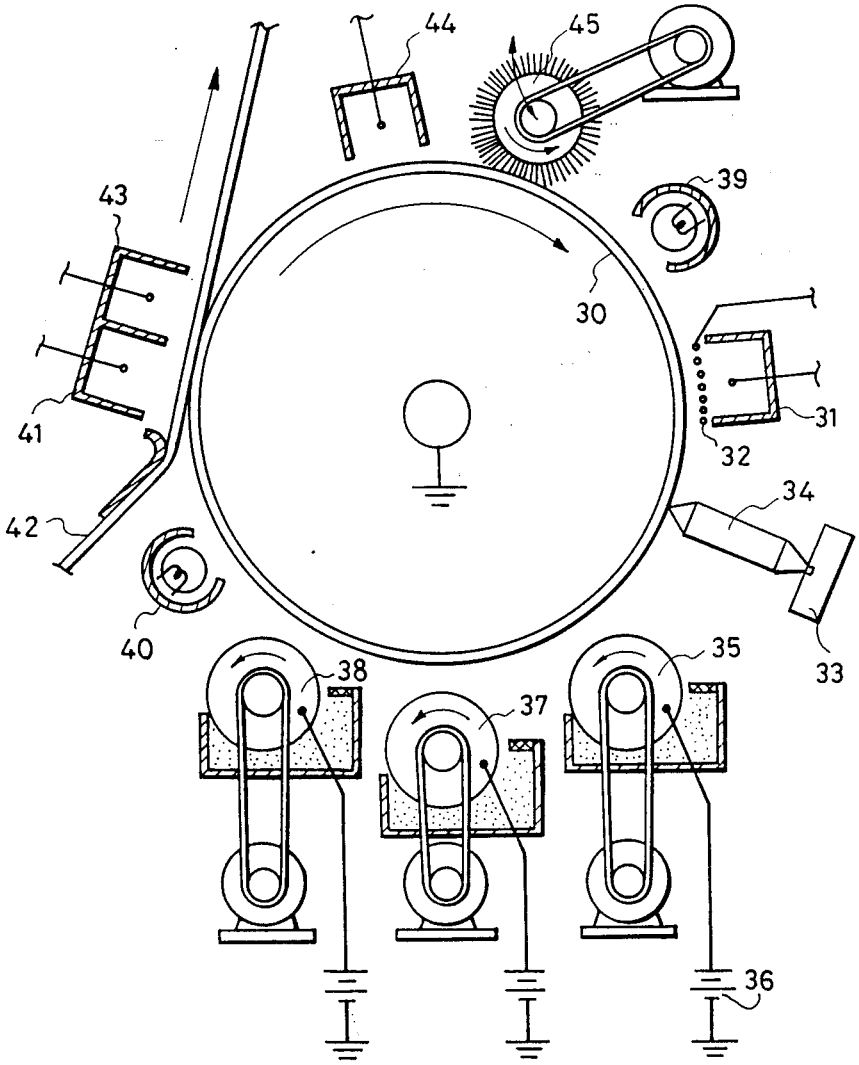
FIG. 4 is a sectional side view of an example of color electrophotographic apparatus in accordance with the present invention.

A first concrete working example is elucidated with reference to FIG. 4. A photoconductor drum 30 of diameter 100 mm having the surface of amorphous Se-Te photoconductor (wherein thickness of the photoconductor was 60 μm and electrostatic capacitance is 92 pF/cm$^2$) are revolved at a surface speed of 75 mm/sec. Then by a corona charger 31 (wherein corona voltage is +7 KV and voltage of the grid 32 is +850 V), the surface of the photoconductor drum was charged to +800 V. Then, the charged surface was exposed to light from a light emitting diode array 33 of 7 μW/dot output and 670 nm wavelength, through a self-focusing rod lens array 34. Thus the charged surface was exposed to the signal light corresponding to yellow image, to produce a latent image.

Then, the surface having the latent image was positioned to oppose the surface of the developer rollers 35, 37 and 38. The developer rollers 35, 37 and 38 has 16 mm diameter and rotating at 75 mm/sec of surface speed in the same direction with respect to opposing surfaces of the photoconductor 30. The first developer 35 bears yellow toner layer of average particle size of 10 μm and layer thickness 30 μm and charged with +3 μC/g at its surface. Developing gap which is between the surface of the toner on the developer roller and the photoconductor is 150 μm. Then, a DC developing bias voltage of +700 V was applied from the DC power source 36, and the yellow toner flew from the developing roller 35 to latent image part of the photoconductor 30 and was deposited thereon. Thickness of the toner layer deposited on the photoconductor 30 was about 10 μm. Thereafter, the yellow-developed photoconductor 30 was driven to move in front of the magenta developer 37 and subsequently to cyan developer 38, both impressed with +850 bias voltage. After thus passing three or four developers of different colors, the toner images consisting of three or four toner layers of different patterns on the photoconductor 30 was subject to the erasing by an eraser lamp 40, for the whole surface area of the photoconductor 30. Thereafter, the color toner images are transfered on a paper 42 by actuating a transfer charger 41, and then the paper 42 was detached from the photoconductor 30 by a peel off charger 43. And finally, the color toner images on the paper 42 was fixed by fusing. After transferring the toner on the photoconductor 30 to the paper 42, the charge on the surface of the photoconductor 30 was dischanged by an eraser 44, and the remaining toner on the photoconductor 30 was removed by actuating cleaning device 45 and the apparatus was made ready for next color copying. The color image on the paper thus obtained has such a high density of 1.7 at maximum density, and good quality image was obtained without any undesirable color contamination.

CONCRETE WORKING EXAMPLE 2

In place of the Se-Te photoconductor used in the concrete working Example 1, an arsenic selenide photoconductor (thickness of the photoconductor layer is 90 μm and the electrostatic capacitance is 104 pF/cm$^2$) was used, and other conditions were the same as that of the concrete working Example 1. Then the obtained printed color image on the paper had such a high density of 1.5 at maximum density, and good quality image was obtained without any undesirable color contamination.

CONCRETE WORKING EXAMPLE 3

An organic photoconductor containing azo pigment as the photoconductor (thickness of the photoconductor layer is 30 μm, and electrostatic capacitance was 80 pF/cm$^2$) was used as the photoconductor, and other conditions were the same as the actual working Example 1, and color printing is made. The obtained color image print had such a high maximum density of 1.7 and there was no color contamination.

CONCRETE WORKING EXAMPLE 4

Three kinds of positive-charge-use color toners of yellow (Y), magenta (M) and cyan (C) were prepared.

(1) The following compositions were mixed for 2 hours at 150° C. and then cooled, ground and sieved to obtain yellow toner of 5–15 μm (average particle size is 10 μm); And the specific dielectric constant of the obtained toner was about 7:

Dielectric material: Barium titanate (ε: 2500) . . . 1 g
Pigment: C.I. pigment yellow #12 . . . 25 g
Binding resin: Styrene-acryl resin . . . 464 g
Change control gent: Amino styrene resin . . . 10 g.

(2) The following compositions were mixed for 2 hours at 150° C. and then cooled, ground and sieved to obtain magenta toner of 5–15 μm (average particle size is 10 μm); And the specific dielectric constant of the obtained toner was about 7:

Dielectric material: Barium titanate (ε: 2500) . . . 1 g
Pigment: C.I. pigment red #5 . . . 30 g
Binding resin: Styrene-acryl resin . . . 454 g
Change control gent: Amino styrene resin . . . 15 g.

(3) The following compositions were mixed for 2 hours at 150° C. and then cooled, ground and sieved to obtain cyan toner of 5–15 μm (average grain size is 10 μm); And the specific dielectric constant of the obtained toner was about 7:

Dielectric material: Barium titanate (ε: 2500) . . . 1 g
Pigment: C.I. pigment blue #15 . . . 25 g
Binding resin: Styrene-acryl resin . . . 464 g
Change control gent: Amino styrene resin . . . 10 g.

Figure 5:
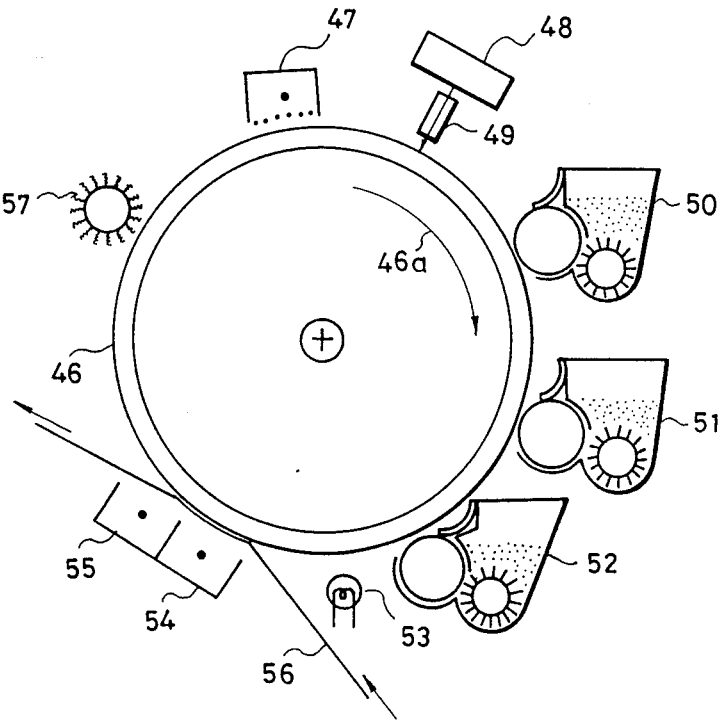
FIG. 5 is a sectional side view of another example of color electrophotographic apparatus in accordance with the present invention.

Next, by using the above-mentioned three kinds of toner, a color picture was made by means of the apparatus shown in FIG. 5. The apparatus of FIG. 5 comprises a scorotron charger 47 (corona voltage is +7 KV, grid voltage is +850), LED array 48 (output is 7 μW/dot, wavelength is 670 nm), a self-focusing rod lens array 49, developers 50, 51 and 52 containing respective toners of yellow magenta and cyan, an eraser lamp 53, and a corona charger 54 for toner transferring, an A.C. eraser 55 for detaching plain paper 56, and a cleaning brush 57, around a photoconductor drum 46 made by vapor depositing Se-Te (thickness of the photoconductor layer is 60 μm, electrostatic capacitance was 92 pF/cm$^2$), in this order.

The developer 50, 51 or 52 is the same one as what is elucidated with reference to FIG. 3. As the toner carrier, an aluminum drum having roughened surface was used, for the fur-brush roller in the developer, a brush made by implanting carbon-containing (specific resistance of $10^6$ Ωcm) rayon fiber implanted on an aluminum pipe was used. Charges on respective toners born on respective toner carrier 50, 51 or 52 at the operation of the developer was 2–5 μC/g. The gap between the photoconductor 46 and the toner carrier is about 150 μm.

Next, forming of image on the photoconductor is elucidated. The photoconductor 46 is rotated in the direction shown by arrow 46a at a surface speed of 100 mm/sec., and by means of the Scorotron charger 47, the photoconductor 46 is charged to +800 V. Subsequently, by means of LED array 48, a yellow image signal was scan-exposured, and a negative electrostatic latent image of +800 V at non-exposed part and +40 V at exposed part are formed. After the exposuring to the yellow image, the photoconductor 46 is passed in front of the three developers 50, 51 and 52, and reversal-development was carried out by yellow toner. Thickness of the developed yellow toner image was about 12 μm. The data of respective developers are as follows:

(1) In the yellow developer 50:
Voltage impressed on the toner carrier: +750 V,
Voltage impressed on the fur-brush: +850 V,
Thickness of the toner layer on the toner carrier: about 40 μm.

(2) In the magenta and cyan developers 51 and 52:
Voltage impressed on the toner carrier: grounded,
Voltage impressed on the fur-brush: grounded,
Thickness of the toner layer on the toner carrier: about 40 μm.

After the development, the photoconductor holding the Y toner image was irradiated by the eraser lamp 53, thereby to light erasing the electrostatic latent image, and the photoconductor was again charged by the Scorotron charger 47. The surface potential of the photoconductor 46 is +800 V at both parts of existence and non- existence of the toner.

Next, an electrostatic negative latent image was formed by scanning exposure of the magenta image signal by the LED array 48. Surface potential of the exposed parts on the region having no Y toner was +40 V, and the surface potential of the exposed parts on the Y toner existence part was 160 V. After the exposing to the magenta image, the photoconductor 46 was passed in front of the developers 50, 51 and 52, and the reversal-development is carried out by magenta toner. The thickness of the obtained composite toner image was about 12 μm at the part of only magenta toner, and 21 μm at the part wherein yellow toner and magenta toner are superposed. At the intended non-exposed part on the yellow toner deposited part, there was no undesirable deposition of the magenta toner. The data of respective developer was as follows:

(1) In the yellow and cyan developers 50 and 52:
Voltage applied to the toner carrier: +750 V,
Voltage impressed on the fur-brush: +550 V,
Thickness of the toner layer on the toner carrier: 0.

(2) In the magenta developer 51:
Voltage impressed on the toner carrier: +750 V,
Voltage impressed on the fur-brush: +850 V,
Thickness of the toner layer on the toner carrier: about 40 μm.

The photoconductor 46 was again erased by light irradiation by the A.C. eraser 55 and then charged by scorotron charger 47. The surface potential of the photoconductor 46 was +800 V irrespective of existence and non-existence of the toner. Next, the photoconductor 48 was light-scanned with cyan image signal by LED array. The surface potential of the exposed part on the no toner part was +40 V, and the surface potential of the exposed part on a single toner layer of yellow or magenta toner only was +160 V and the surface potential of the exposed part on the double toner layers of yellow and magenta toners superposition was +220 V.

Next, the photoconductor 46 was passed in front of three developers 50, 51 and 52, which were set in the below-mentioned respective conditions, and the latent image was reversal-developed by cyan toner. Then, there was no cyan toner deposited on the non-exposed parts on either of and both the yellow and magenta toner deposited parts. The data of the respective developers were as follows:

(1) In the yellow and magenta developers 50 and 51:
Voltage applied to the toner carrier: +750 V,
Voltage applied to the fur-brush: +550 V,
Thickness of the toner layer on the toner carrier: 0.

(2) In the cyan developer 52:
Voltage applied to the toner carrier: +750 V,
Voltage applied to the fur-brush: +850 V,
Thickness of the toner layer on the toner carrier: about 40 μm.

Next, after wholly irradiating the surface of the photoconductor 46 by the eraser lamp 53, the toner images on the photoconductor 46 were transferred on the plain paper 56 by means of the corona charger 54 (corona voltage is 5.5 KV), and subsequently, the plain paper 56 was detached from the photoconductor 46 by the A.C. charger 55. Thereafter, the toner image transferred on the plain paper 56 was fused by a known fuser (not shown) and a stable color printing was obtained. After above, very small amount of the remaining toner on the photoconductor 46 was removed by cleaning brush 57 and the apparatus was prepared for the next image copying. As a result of the above-mentioned sequence of the color printing, even though the photoconductor which already has the toner image thereon was recharged, the hitherto-observed undesirable lowering of the photoconductor potential at the part where another toner was already deposited does not take place. Resultantly, a clear color print without color contamination was obtained.

COMPARISON EXAMPLE 1

A comparison toner was prepared by removing the barium titanate from the toner composition as described in the actual working Example 1. The specific dielectric constants of the three kinds of toner thus obtained was selected about 2.2, respectively. When color prints was made by using this comparison example toner, by the similar process as elucidated in the actual working Example 4, the cyan toner was undesirably deposited on the part to become red (wherein yellow toner and magenta toner only were to be deposited). Therefore clear red was not obtained. At that time, after re-charging the photoconductor at the part developed by the magenta toner, the surface potential of the part wherein the yellow toner and magenta toner were superposed (making total toner layer thickness of about 24 μm) was measured, and the surface potential was about 400 V.

CONCRETE WORKING EXAMPLE 5

In place of the Se-Te photoconductor used in the concrete working Example 4, an arsenic selenide photoconductor (thickness of the photoconductor layer was 60 μm and the electrostatic capacitance was 156 pF/cm$^2$) was used, and other conditions are the same as that of the concrete working example 4, in making a color printed image. The obtained printed color image on the paper had similar clear color, and no color contamination was observed.

COMPARISON EXAMPLE 2

Using the toner described in the COMPARISON EXAMPLE 1, color printed images were made by the same process as described in the CONCRETE WORKING EXAMPLE 5. The obtained printed color image had considerable color contaminations such that magenta and yellow toners were undesirably deposited on the parts to be represented as yellow, and yellow toner was undesirably deposited on the parts to be represented as magenta and red. At that time, after re-charging the photoconductor at the part bearing one kind of toner, the surface potential of the part wherein the toner was deposited (toner layer thickness was about 12 μm) was measured, and the surface potential was about 400 V. Furthermore, after re-charging the photoconductor at the part bearing two kinds of toners, the surface potential of the part wherein the two kinds of toners were superposedly deposited (toner layer thickness was about 24 μm) was measured, and the surface potential was about 250 V.

CONCRETE WORKING EXAMPLE 6

Another concrete working example is elucidated with reference to FIG. 6, the developers 58, 59 and 60 are non contact type non-magnetic single-component developer wherein toners are made fly by DC electric field, and respectively comprise aluminum-made developer rollers 61, 62 and 63, on each surface thereof a thin layer of toner is formed by blades 64. The developers 58, 59 and 60 contain yellow toner, magenta toner and cyan toner, respectively, and these toners are of insulative property. The developing rollers 61, 62 and 63 are disposed around the surface of the photoconductor 65 with a specified developing gap to the surface of the photoconductor 65. And respective developer comprise a distance control mechanism which controls the gap between the developing 61, 62 or 63, and the photoconductor drum 65, in a manner that each roller is moved close to the photoconductor when developing is made and is removed from the photoconductor when not developing. The details of the data of the developer and the developing conditions and physical property of the toners are as follows:

Details of the developer and the developing conditions:

Diameter of the developing roller: 16 mm,
Peripheral speed of the developing roller: 150 mm/sec,
Toner layer thickness on the developing roller: 30 μm,
Direction of rotation of the developing roller:
opposite to the direction of photoconductor 65,
Developing gap during the development: 150 μm,
Developing gap when the developers is not developing: 700 μm.

Physical properties of toner:
Charge of the toner: +3 μC/g,
Average particle size: 10 μm.

A photoconductor drum 65 of 100 mm diameter having Se-Te photoconductor was rotated at a peripheral speed of 150 mm/sec. and the surface of the photoconductor was charged by a corona charger 66 (corona voltage: +7 KV) to a surface potential of +800 V. Then, by irradiating LED array 67 of 670 nm wavelength and 7 μmW/dot output, negative yellow signal light is irradiated on the photoconductor surface 65 through rod lens array 68, to produce an electrostatic latent image. The contrast potential of the latent image was 750 V. Reversal-developing of the above-mentioned latent image was made by a yellow developer 58, which was made then to a developing state by applying +700 V voltage to the developing roller 61. Then, the photoconductor 65 was passed in front of the magenta developer 59 and the cyan developer 60 both in non-developing state, and yellow toner image was formed. After the development, the whole surface of the photoconductor 65 was irradiated by eraser lamp 69, thereby to erase the latent image.

Next, again by the corona charger 66 (corona voltage: +7.3 KV), the photoconductor 65 was charged to +850 V. Then, by the LED array 67 the photoconductor 65 was exposed to signal light image of magenta signal, thereby to produce electrostatic latent image for magenta image. The surface potential of the exposed part formed on the previously formed yellow toner image layer was +100 V, and the contrast potential of the above-mentioned latent image was 750 V. Subsequently, the photoconductor 65 was passed in front of the yellow developer 58 of non-developing state, and further in front of the magenta developer 59 wherein the developing roller 62 was applied with +800 V, and in front of cyan developer 60 of non-developing state, thereby to produce toner image of magenta color. After the development, the latent image was erased by irradiating the whole surface of the photoconductor by the eraser lamp 69.

Next, again by the corona charger 66 (corona voltage: +7.5 KV), the photoconductor 65 was charged to +950 V. Then, by LED array 67 the photoconductor 65 was exposed to light image of cyan signal, thereby to produce electrostatic latent image for cyan image. The surface potential of the exposed part formed on the previously formed magenta toner image layer was +100 V; the surface potential of the exposed part formed on the layer of images made by superposing the yellow toner and magenta toner was +200 V; and the contrast potential of the above-mentioned latent image was 750 V. Subsequently, the photoconductor 65 was passed in front of the yellow developer 58 of non-developing state, magenta developer 59 of non-developing state and cyan developer 60 of developing state wherein the developing roller 63 was impressed with +900 V to realize the developing state, thereby to form a cyan toner image.

The color toner image obtained thus on the photoconductor 65 was transferred to a plain paper by means of the transfer charger 70, and thereafter the color image of the toners was fixed by fusing. Then, the surface of the photocondcutor 65 was erased by the eraser lamp 69, and the photoconductor 65 was cleaned by pressing a revolving fur-brush 72 thereon.

As a result, a clear color image which has color density of composite color of red, green and blue was above 1.5, and color density of three color superposed part of yellow toner magenta toner and cyan toner was above 1.7, and there was no undesirable color contamination.

COMPARISON EXAMPLE 3

Using the apparatus described in the COMPARISON EXAMPLE 1, color printed images were made by setting the condition such that initial potential of the photoconductor for each cycle of printing for one color was +800 V, and bias for develoing of the developer was +700 V. Then, contrast potentials in the yellow cycle was 750 V, in the magenta cycle was 700 V and in the cyan cycle was 600 V. Color density of a composite color of red, green and blue was 1.2; and color density for three color superposition of yellow, magenta and cyan was 1.3.

CONCRETE WORKING EXAMPLE 7

Figure 6A:
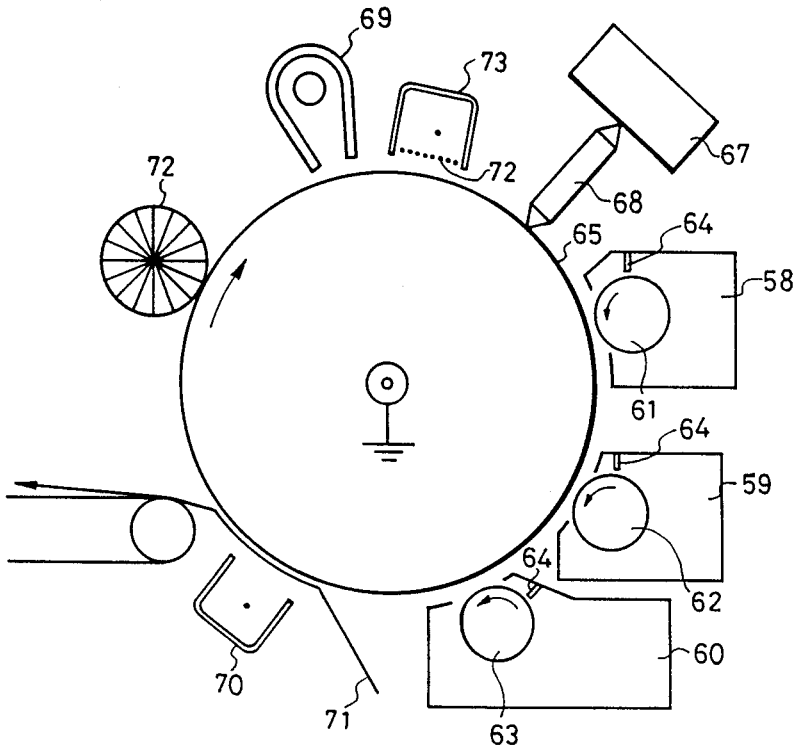
FIG. 6A is a sectional side view of another example of color electrophotographic apparatus in accordance with the present invention.
Figure 7:
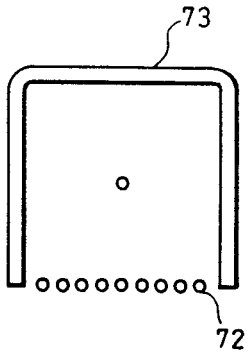
FIG. 7 is a sectional side view showing one example of a corona charger to be used in the example of FIG. 6A.

A color image print was made by an apparatus shown in FIG. 6A wherein a Scorotron charger 73 shown in FIG. 7 is used in place of the corona charger 66 of the CONCRETE WORKING EXAMPLE 6. The Scorotron charger of FIG. 7 has grid electrodes 72.

Rotating the photoconductor drum 65 at a peripheral speed of 150 mm/sec., by the Scorotron charger 73 (corona voltage: +7 KV, grid voltage 750 V), the charging was made to obtain a surface potential of +800 V. Next, by driving the LED array 67 of 670 nm wavelength and 7 μW/dot output, the photoconductor 65 was exposed to the negative yellow image signal light through the rod lens array 68, to make a latent image. The contrast potential of the latent image was 750 V. Reversal-development was made by the yellow developer 58, which was made to the developing state by appyling +700 V to the developing roller 61 thereof. Then, the photoconductor 65 bearing the yellow toner thereon was passed in front of the magenta developer and cyan developer which were in non-developing state. Thus a yellow toner image was made. After the yellow development, the latent image on the photoconductor surface 65 was erased by irradiation by the eraser lamp 69 on the whole surface thereof.

Next, the photoconductor 65 was again charged by the corona charger 73 (corona voltage: +7 KV, grid voltage 800 V), to make the surface potential of the photoconductor 65 to 750 V. Thereafter, the photoconductor 65 was exposed to magenta image signal light by the LED array 67, thereby to make electrostatic latent image of magenta. The surface potential of the exposed part formed on the yellow toner image was +100 V, and the contrast potential of the latent image was 750 V. Then, the photoconductor 65 was passed in front of the yellow developer 58 of non-developing state, magenta developer 59 which was made in the developing state by application of +800 V to the developing roller 62 and the cyan developer 60 of non-developing state, thereby to produce a magenta toner image. And thereafter, the whole photoconductor surface was irradiated by the eraser lamp 69 to erase the latent image.

Next, the photoconductor 65 was again charged by the corona charger 74 (corona voltage: +7 KV, grid voltage 900 V), to make the surface potential of the photoconductor 65 to 750 V. Thereafter the photoconductor was exposed to cyan image signal light by the LED array 67, thereby to make electrostatic latent image of cyan. The surface potential of the exposed part formed on the magenta toner image was +200 V, and the contrast potential of the latent image was 750 V. Then, the photoconductor 65 was passed in front of the yellow developer 58 and magenta developer 59 which were in non-developing state, and cyan developer 60 which was made in the developing state by application of +900 V to the developing roller 62, thereby to produce a cyan toner image.

After transferring the color toner image made on the photoconductor 65 to the plain paper 71 by means of a transfer charger 70, the transferred toner image was fixed by fusing. After removing the toner image, the surface of the photoconductor 65 was erased of charge by the eraser 69, and further the surface of the photoconductor 65 was cleaned by pressing the fur-brush 72 thereon.

The resultant color image print has color density of 1.5 or higher of composite color of red, green and blue; and color density for three color superposition of yellow, magenta and cyan was 1.7 or higher.

CONCRETE WORKING EXAMPLE 8

Figure 6B:
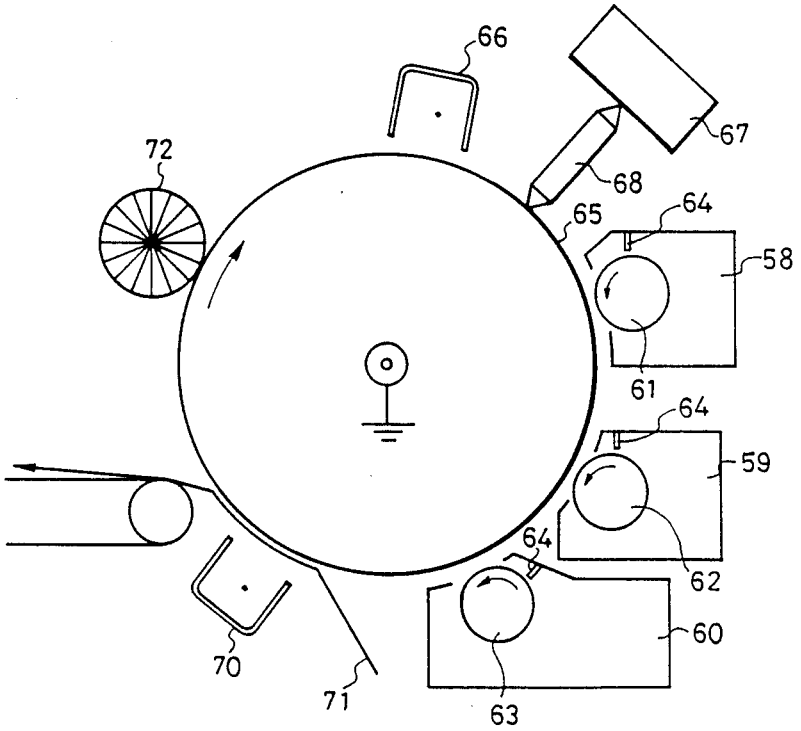
FIG. 6B is a sectional side view of another example of color electrophotographic apparatus in accordance with the present invention.

A color image print was made by using an apparatus shown in FIG. 6B, which uses the similar components and process as described in the CONCRETE WORKING EXAMPLE 6 with reference to FIG. 6, but excluding the eraser 69.

Rotating the photoconductor drum 65 at a peripheral speed of 150 mm/sec., by the charger 66 (corona voltage: +7 KV), the charging was made to obtain a surface potential of +800 V. Next, by driving the LED array 67 of 670 nm wavelength and 7 μW/dot output, the photoconductor 65 was exposed to the negative yellow image signal light through the rod lens array 68, to make a latent image. The contrast potential of the latent image was 750 V. Reversal-development was made by the yellow developer 58, which was made to the developing state by impressing +700 V on the developing roller 61 thereof. Then, the photoconductor 65 bearing the yellow toner thereon was passed in front of the magenta developer and cyan developer which were in non-developing state. Thus a yellow toner image was made.

Next, the photoconductor 65 was again charged by the corona charger 66 (corona voltage: +7 KV), to make the surface potential of the photoconductor 65 to 850 V. Thereafter, the photoconductor 65 was exposed to magenta image signal light by the LED array 67, thereby to make electrostatic latent image of magenta. The surface potential of the exposed part formed on the yellow toner image was +100 V, and the contrast potential of the latent image was 750 V. Then, the photoconductor 65 was passed in front of the yellow developer 58 of non-developing state, magenta developer 59 which is made in the developing state by application of +800 V to the developing roller 62 and the cyan developer 60 of non-developing state, thereby to produce a magenta toner image.

Next, the photoconductor 65 was again charged by the corona charger 66 (corona voltage: +7 KV), to make the surface potential of the photoconductor 65 to 950 V. Thereafter, the photoconductor was exposed to cyan image signal light by the LED array 67, thereby to make electrostatic latent image of cyan. The surface potential of the exposed part formed on the magenta toner image was +100 V, the surface potential of the exposed part formed on the superposed layers of yellow and magenta toners was +200 V, and the contrast potential of the latent image was 750 V. Then, the photoconductor 65 was passed in front of the yellow developer 58 and magenta developer 59 which were in non-developing state, and cyan developer 60 which was made in the developing state by impression of +900 V on the developing roller 63, thereby to produce a cyan toner image.

After transferring the color toner image made on the photoconductor 65 to the plain paper 71 by means of a transfer charger 70, the transferred toner image was fixed by fusing. After removing the toner image, the surface of the photoconductor 65 was cleaned by pressing the furbrush 72 thereon.

The resultant color image print has color density of 1.5 or higher of composite color of red, green and blue; and color density for three color superposition of yellow, magenta and cyan was 1.7 or higher, and there was no color contamination.

CONCRETE WORKING EXAMPLE 9

Figure 6C:
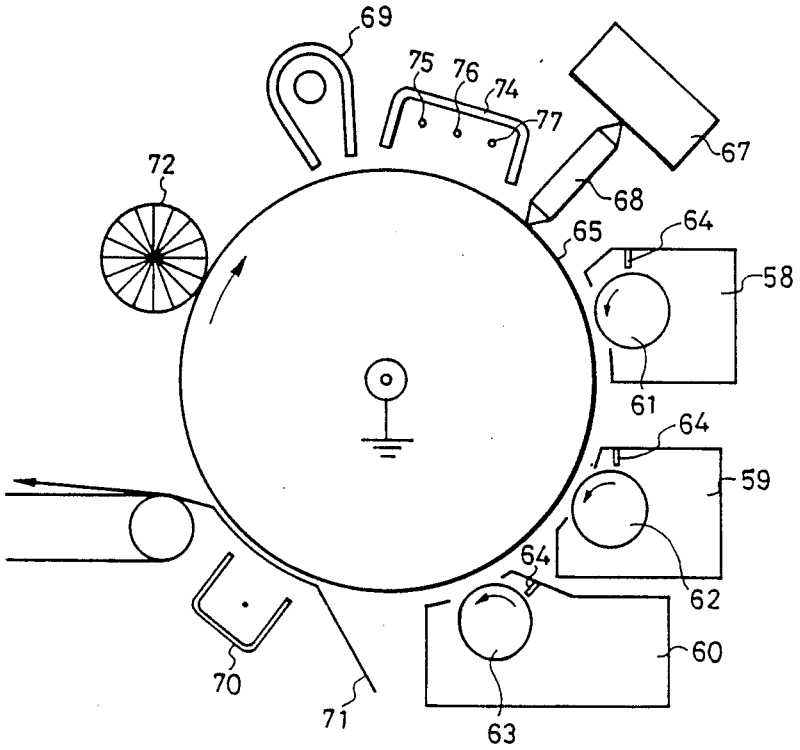
FIG. 6C is a sectional side view of another example of color electrophotographic apparatus in accordance with the present invention.
Figure 8:
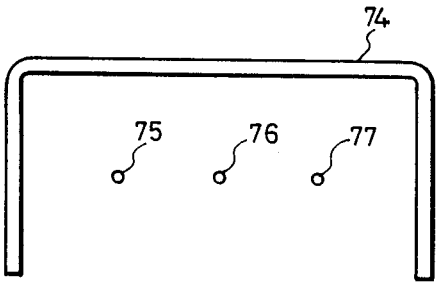
FIG. 8 is a sectional side view of another example of a corona charger to be used in the example of FIG. 6C.

A color image print was made by using an apparatus shown in FIG. 6C, which uses a charger 74 having three corona wires 75, 76, 77 as shown in FIG. 8. Using this charger 74, as the cycle of respective colors advances, number of corona wires impressed with corona voltage was increased and time period to charge the photoconductor was also increased.

First, rotating the photoconductor drum 65 at a peripheral speed of 150 mm/sec., by the charger 74, with its first corona wire 75 impressed with a corona voltage of 7 KV, the charging was made to obtain a surface potential of +800 V. Then, by driving the LED array 67 of 670 nm wavelength and 7 μW/dot output, the photoconductor 65 was exposed to the negative yellow image signal light through the rod lens array 68, to make a latent image. The contrast potential of the latent image was 750 V. Reversal development was made by the yellow developer 58, which was made to developing state by impressing +700 V on the developing roller 61 thereof. Then, the photoconductor 65 bearing the yellow toner thereon was passed in front of the magenta developer and cyan developer, which were in non-developing state. Thus a yellow toner image was made.

Next, the photoconductor 65 was again charged by the corona charger 74, wherein both the two corona wires 75 and 76 were charged by +7 KV corona voltage, to make the surface potential of the photoconductor 65 to 850 V. Thereafter, the photoconductor was exposed to magenta image signal light by the LED array 65, thereby to make electrostatic latent image of magenta. The surface potential of the exposed part formed on the yellow toner image was +100 V, and the contrast potential of the latent image was 750 V. Then, the photoconductor 65 is passed in front of the yellow developer 58 of non-developing state, magenta developer 59 which was made in the developing state by impression of +800 V on the developing roller 62 and the cyan developer 60 of non-developing state, thereby to produce a magenta toner image. After the development, the whole photoconductor surface was irradiated by the eraser lamp 69, to erase the latent image.

Next, the photoconductor 65 was again charged by the corona charger 74, wherein, in this case, all of three corona wires 75, 76 and 77 are applied with the corona voltage of +7 KV, to make the surface potential of the photoconductor 65 to +950 V. Thereafter, the photoconductor 65 was exposed to cyan image signal light by the LED array 67, thereby to make electrostatic latent image of cyan. The surface potential of the exposed part formed on the magenta toner image was +100 V, the surface potential of the exposed part formed on the superposed layers of yellow and magenta toners was +200 V and the contrast potential of the latent image was 750 V. Then, the photoconductor 65 is passed in front of the yellow developer 58 and magenta developer 59 which are in non-developing state, and cyan developer 60 which was made in the developing state by application of +900 V to the developing roller 63, thereby to produce cyan toner image. After the development, the whole surface of the photoconductor 65 was irradiated by eraser lamp 69, thereby to erase the latent image.

The color toner image thus produced on the photoconductor 65 was then transferred to a plain paper 71 by means of a transferring charger 70, and the transferred toner image was fixed by fusing. After the transferring, the surface of the photoconductor 65 was cleaned by the eraser lamp 69, and further was cleaned by pressing the fur-brush 72 thereon.

The resultant color image print has color density of 1.5 or higher of composite color of red, green and blue; and color density for three color superposition of yellow, magenta and cyan was 1.7 or higher, and there was no color contamination.

As has been described above, according to the present invention, there was no potential lowering on the surface of the toner layer which has been previously formed on the photoconductor drum, even in the case of the re-charging for the second or third cycle of development, and images of clear color without color contamination is obtainable. Therefore, color images of high color density of composite color was obtainable at stable reproducibility. Furthermore, the present invention enables providing a color electrophotographic apparatus capable of easy adjustment of color balance and free of color contamination.

What is claimed is:

1. Color electrophotographic process having plural sequential electrophotographic steps of producing plural color toner images of different colors each comprising:

forming an electrostatic latent image on a photoconductor layer having electrostatic capacitance of 170 pF/cm$^2$ or smaller, putting thin layer of toner on a toner carrier, surface thereof being situated to oppose surface of said photoconductor layer with a predetermined gap not to make touching of both said surfaces, and applying D.C. potential between said photoconductor layer and said toner carrier, thereby to develop said latent image by a process of toner flying under D.C. electric field, transferring accumulated toner images on said photoconductor made by said sequential electrophotographic steps onto a recording medium at one time, and fixing said transferred accumulated toner images on said recording medium.

2. Color electrophotographic process in accordance with claim 1, wherein said electrostatic capacitance is 20 pF/cm$^2$ or higher.

3. Color electrophotographic process in accordance with claim 1, wherein said photoconductor layer is Se photoconductor layer having layer thickness of 35–90 μm.

4. Color electrophotographic process in accordance with claim 1, wherein said photoconductor layer is arsenic selenide photoconductor layer having layer thickness of 65–90 μm.

5. Color electrophotographic process in accordance with claim 1, wherein said photoconductor layer is organic photoconductor layer having layer thickness of 15–50 μm.

6. Color electrophotographic process in accordance with claim 1, wherein gap between said toner carrier and the photoconductor layer is 250 μm or smaller.

7. Color electrophotographic process in accordance with claim 1, wherein said development is a reversal development.

8. Color electrophotographic process in accordance with claim 1, wherein average toner layer thickness of uniform toner layer part made by each development for one color is selected in a range of 5–30 μm.

9. Color electrophotographic process in accordance with claim 1, wherein said toner is of non-magnetic toner having average particle size of 12 μm or smaller.

10. Color electrophotographic process in accordance with claim 1, wherein said toner has 1–5 C/g charge.

11. Color electrophotographic process in accordance with claim 1, wherein said toner has a specific dielectric constant of 3 or higher.

12. Color electrophotographic process in accordance with claim 1, wherein said toner contains inorganic dielectric substance.

13. Color electrophotographic process in accordance with claim 12, wherein said dielectric substance in one member selected from the group consisting of barium sulphate, alumina, barium titanate and titanium oxide.

14. Color electrophotographic process in accordance with claim 1, wherein charged surface potentials of said photoconductor raised to be higher as the order of cycle of development advances.

15. Color electrophotographic process in accordance with claim 14, wherein said raising of charged potential is made by raising potential to be applied to a corona charger for charging the photoconductor.

16. Color electrophotographic process in accordance with claim 14, wherein said photoconductor is charged by a scorotron charger.

17. Color electrophotographic process in accordance with claim 16, wherein said raising of charged potential is made by raising voltage to be applied to grid electrodes of said scorotron charger.

18. Color electrophotographic process in accordance with claim 14, wherein said raising of charged potential is made by charging by a corona charger of a constant output voltage to be impressed on the photoconductor for a predetermined constant time period for respective developing cycle, and by accumulating the charges of respective developing cycles by non-erasing of said photoconductor after completion of each developing cycle.

19. Color electrophotographic process in accordance with claim 14, wherein said raising of charged potential is made charging by a corona charger of a constant output voltage to be impressed on the photoconductor for such time periods as to be increased as the order of the developing cycle advances.

20. A color electrophotographic apparatus comprising:

latent image forming means for forming plural electrostatic latent images respectively corresponding to image signals of different colors on a surface of a photoconductor layer having electrostatic capacitance of 170 pF/cm$^2$ or smaller, plural developing means each having a toner carrier, surface whereof is situated to oppose surface of said photoconductor layer with a predetermined gap not to make touching of both of said surfaces, which are disposed in the vicinity of said photoconductor and respectively contain toners of different colors corresponding to said different color image signals, said voltage application means for applying a D.C. voltage between said photoconductor layer and said toner carrier, to make development of said latent image by toner flying under D.C. electric field, transferring means for transferring accumulated toner images made by sequential electrophotographic steps onto a recording medium at one time, and fixing means for setting transferred accumulated toner images on said recording medium.

* * * * *